US007520149B1

(12) United States Patent
Roemmele

(10) Patent No.: US 7,520,149 B1
(45) Date of Patent: Apr. 21, 2009

(54) WRITING INSTRUMENT AND HANDCUFF ACCESSORY AND METHOD

(76) Inventor: Travis Roemmele, 35 Caroline Ave., Pompton Plains, NJ (US) 07444

( * ) Notice: Subject to any disclaimer, the term of this patent is extended or adjusted under 35 U.S.C. 154(b) by 0 days.

(21) Appl. No.: 12/029,023

(22) Filed: Feb. 11, 2008

Related U.S. Application Data

(60) Provisional application No. 60/951,049, filed on Jul. 20, 2007.

(51) Int. Cl.
*A47G 29/10* (2006.01)

(52) U.S. Cl. ..... 70/16; 70/404; 70/456 R; 70/459; 401/52; 401/195

(58) Field of Classification Search ..... 70/16, 70/403, 404, 456 R, 459; 24/3.6; 7/118, 7/168; 401/52, 195; 206/38.1, 37.1–37.8; D19/36
See application file for complete search history.

(56) References Cited

U.S. PATENT DOCUMENTS 1,795,555 A * 3/1931 Greenwood ..... 70/459
2,077,728 A * 4/1937 Whitney ..... 70/150
2,204,740 A * 6/1940 Whitney ..... 401/52
3,064,624 A 11/1962 Hechtle
3,191,329 A 6/1965 Shea
4,778,302 A 10/1988 Martinez
4,991,988 A 2/1991 Snell et al.
5,460,022 A 10/1995 Parsons
5,568,741 A 10/1996 Parsons
6,390,706 B1 5/2002 Yokouchi et al.
6,773,185 B1 8/2004 Hsieh
6,880,369 B2 4/2005 Parsons

* cited by examiner

*Primary Examiner*—Lloyd A Gall
(74) *Attorney, Agent, or Firm*—Thomas L. Adams

(57) ABSTRACT

A combination writing instrument and handcuff accessory has a housing containing an elongated writing element with a writing tip. The housing has at its distal end a key suitable for opening a handcuff. The key has a longitudinal tunnel sized to allow passage of the writing tip. The housing also has a mechanism for reciprocating the writing element between a retracted and an extended position. The writing tip in the extended position extends (a) through the tunnel, and (b) outside the housing a predetermined distance. The portion of the writing element extending from the key can be inserted into a double lock hole of a handcuff.

13 Claims, 2 Drawing Sheets

WRITING INSTRUMENT AND HANDCUFF ACCESSORY AND METHOD

CROSS-REFERENCES TO RELATED APPLICATIONS

This application claims the benefit of U.S. Provisional Patent Application Ser. No. 60/951,049, filed 20 Jul. 2007, the contents of which are hereby incorporated by reference herein.

BACKGROUND OF THE INVENTION

1. Field of the Invention

The present invention relates to writing instruments with handcuff accessories, including equipment and techniques for unlocking handcuffs and operating a double lock on a handcuff.

2. Description of Related Art

Law enforcement and security officials commonly carry restraining devices such as a pair of handcuffs. Each handcuff can be a hinged pair of C-shaped elements that can encircle a wrist and lock together. The handcuff industry has standardized on the key for unlocking the handcuffs. This allows an officer to carry a single key without concern for the type or brand of handcuffs. The standard key has a hollow stem with a radially projecting, rectangular, unlocking paddle.

Handcuffs normally have a double look feature that prevents further tightening of the handcuffs. This feature is operated by inserting a small pointed object into a hole in order to double lock the handcuff. Thereafter, a handcuffed suspect cannot inadvertently tighten the handcuffs to a point where an officer must intervene to alleviate pain or prevent possible injury to the suspect. Readjusting tight handcuffs is highly undesirable since the handcuff must be unlocked, giving the suspect an opportunity to resist or attempt an escape.

Handcuffs are used in emergent and often dangerous circumstances. An officer needs immediate access to the handcuff key and an implement for operating the double locking feature. Since a conventional handcuff key is typically rather small, the officer may have difficulty quickly finding it. Also, carrying two different accessories (key and double locking implement) creates clutter requiring an officer to search through several items before selecting the needed accessory.

In addition, while these handcuff accessories must be immediately accessible, they should not be immediately visible otherwise they may tempt a suspect to grab the key in an effort to escape. Also, the pointed implement used to actuate the double locking feature should not give the appearance of a possible weapon that a suspect might try to use against an officer.

Known retractable ballpoint pens employ a hollow housing containing a writing element that is spring biased toward a retracted position. The writing element can be extended by depressing a coaxial button having an internal cylindrical barrel rimmed with circumferentially spaced teeth providing cam surfaces. Slid into this cylindrical barrel is a cup-shaped shuttle having an inside open end with radially projecting teeth. By depressing the coaxial button the cam surfaces of the cylindrical barrel can rotate the teeth of the cylindrical shuttle an indexed amount thereby positioning the shuttle teeth to either (a) slide between longitudinal ribs formed on the inside of the hollow housing or (b) rest on the inside end of the ribs. Since its non-writing end is inserted into the cylindrical shuttle, the writing implement is extended or retracted depending on the position of the shuttle. For writing instruments of this type see U.S. Pat. Nos. 3,191,329; and 4,991,988.

See also U.S. Pat. Nos. 3,064,624; 4,778,302; 5,460,022, 5,568,741; 6,390,706, 6,773,185; and 6,880,369.

SUMMARY OF THE INVENTION

In accordance with the illustrative embodiments demonstrating features and advantages of the present invention, there is provided a combination writing instrument and handcuff accessory. The combination has a housing assembly and an elongated writing element with a writing tip. The housing assembly has a distal and a proximal end and is adapted to receive the writing element. The housing assembly has a key at the distal end that is suitable for opening a handcuff. The key has a longitudinal tunnel sized to allow passage of the writing tip. The housing assembly also has a mechanism for reciprocating the writing element between a retracted and an extended position. The writing tip in the extended position extends (a) through the tunnel, and (b) outside the housing assembly a predetermined distance.

In accordance with another aspect of the invention, a method is provided that employs a hollow key formed on the writing end of a writing instrument containing a retractable writing element. The method includes the step of extending the writing element from the writing instrument through the key. Another step is inserting the portion of the writing element extending from the key into a double lock hole of a handcuff.

In accordance with another aspect of the invention there is provided a combination writing instrument and handcuff accessory. The combination has a housing assembly and an elongated writing element with a writing tip. The housing assembly has a distal and a proximal end and is adapted to receive the writing element. The housing assembly has an external clip at the proximal end of the housing assembly for holding it in a shirt pocket. The housing assembly has at its distal end a key suitable for opening a handcuff. The key includes a cylindrical collar having a distal portion with a radially extending rectangular tab. The collar has a longitudinal tunnel sized to allow passage of the writing tip. The housing assembly also has a mechanism for reciprocating the writing element between a retracted and an extended position. The wring tip in the extended position extends (a) through the tunnel, and (b) outside the housing assembly a predetermined distance. The writing tip has a length exceeding that of the tunnel by about the predetermined distance. The mechanism has a longitudinal pushbutton extending externally from the proximal end of the housing assembly. The pushbutton has an internal distal cam surface. The mechanism also has a shuttle mounted coaxially in the pushbutton. The shuttle has distal teeth for engaging the cam surface. The writing element is coaxially mounted in the shuttle. The housing assembly has longitudinal ribs distributed circumferentially inside the housing assembly around the shuttle. The distal teeth are positionable to either slide between or rest end to end on the longitudinal ribs.

By employing apparatus and methods of the foregoing type one can achieve an improved handcuff accessory that is combined with a writing instrument. In a disclosed embodiment the writing instrument has a writing element mounted inside a hollow housing. In this embodiment a pushbutton has an inside cup-shaped, cylindrical barrel ending in cam surfaces. Slidably mounted in the barrel is a cylindrical shuttle with radial teeth. The cam surfaces of the cylindrical barrel can engage the shuttle's teeth and thereby rotatably index the cylindrical shuttle. The writing element is mounted in the cylindrical shuttle and can be reciprocated between an extended and a retracted position as the radial teeth of the cylindrical shuttle alternate between a position (a) between longitudinal ribs on the inside of the housing, and (b) perched at the inside ends of these longitudinal ribs.

When the disclosed writing element is extended, its writing tip projects through a cylindrical collar. The cylindrical collar has a rectangular tab, giving the collar the shape of a handcuff key. When the writing element is retracted the cylindrical collar is empty and can be used as a handcuff key. When the writing element is extended through the collar, it extends far enough to be useful as a pointed implement for actuating the double lock feature of a handcuff. The extended writing element can also be used as a pen for writing.

This combined writing instrument and handcuff accessory can have a clip allowing it to be worn in an office's shirt pocket for immediate access in an emergency. Since this device then has the appearance of an ordinary ballpoint pen, a suspect will have no reason to believe the device could be used to unlock handcuffs, could be used as a weapon, or otherwise used to facilitate an escape.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION OF THE PREFERRED EMBODIMENTS

Figure 1:
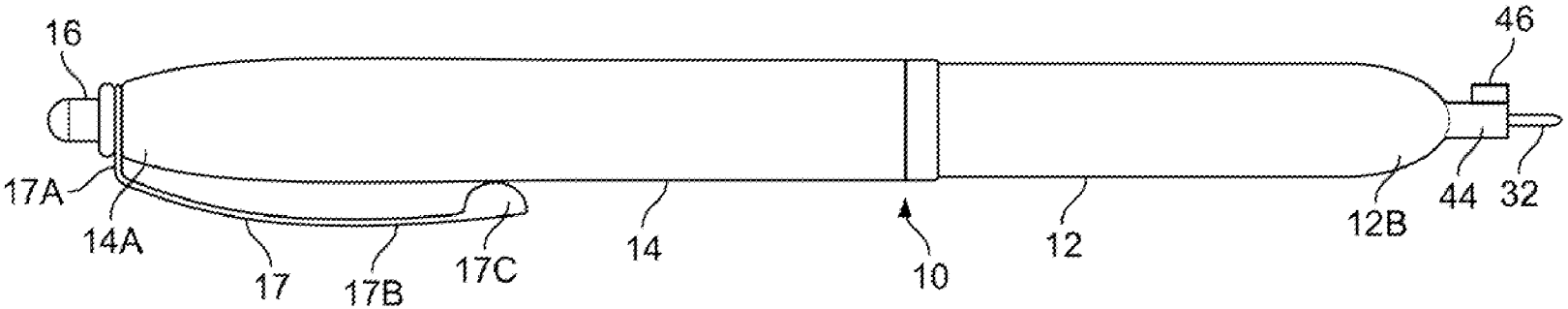
FIG. 1 is a side view of a combination writing instrument and handcuff accessory in accordance with principles of the present invention.
Figure 2:
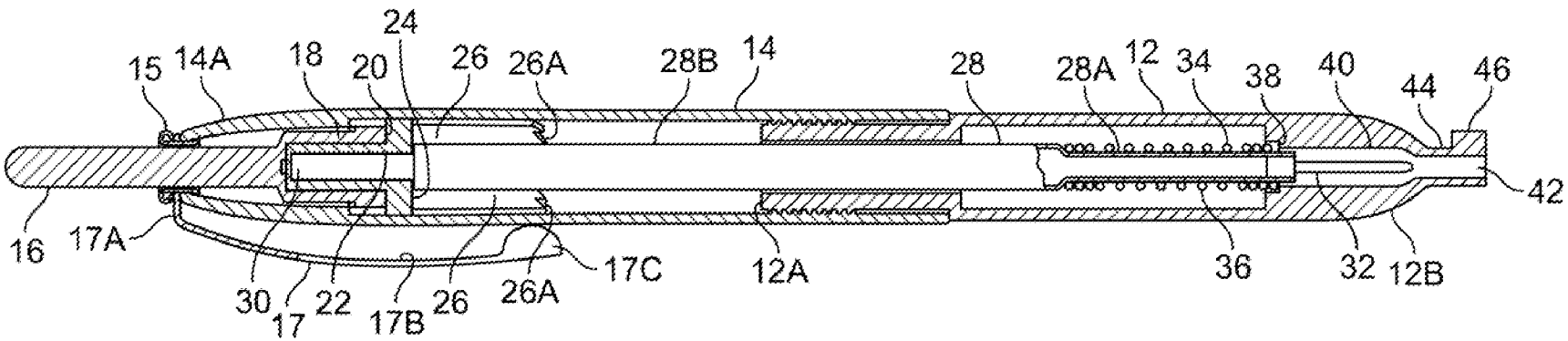
FIG. 2 is a longitudinal sectional view of the combination of FIG. 1.

Referring to FIGS. 1 and 2, the illustrated combination writing instrument and handcuff accessory has a hollow housing assembly 10 with a distal section 12 and a proximal section 14. In this embodiment sections 12 and 14 are made of stainless steel for durability and strength, although other materials may be employed in other embodiments. The proximal end of section 12 is formed into a smaller, externally threaded neck 12A shown screwed into the internal threads on the distal end of section 14.

Tubular rivet 15 is fitted into a coaxial hole in the proximal end 14A of section 14. The proximal end 17A of clip 17 is formed into a ring that encircles rivet 15. The inside edge of rivet 15 is swaged and its outside edge is rolled to rivet clip 17 to the proximal end 14A of section 14. External clip 17 has a springy arm 178 ending in a nub 17C that presses against the side of section 14.

Longitudinal pushbutton 16 extends coaxially through rivet 15. The inside portion of pushbutton 16 is formed into cup-shaped cylindrical barrel 18. The rim 20 of barrel 18 has a sawtooth shape presenting a plurality of contiguous, symmetrical teeth (shaped like isosceles triangles), each acting as a distal cam surface.

Coaxially and slidably fitted inside barrel 18 is a cup-shaped shuttle 22. A number of distal teeth 24 radially and outwardly project from the open inside end of shuttle 22. The backside of each tooth 24 is beveled and designed to engage cam surfaces 20.

The interior of section 14 is formed into a number of spaced longitudinal ribs 26. The exterior of barrel 18 is splined so that ribs 26 stop barrel 18 from rotating. Ribs 26 are equal in number to the teeth 24 and are circumferentially spaced to allow teeth 24 to slide between the ribs as shown. The distal tips 26A of ribs 26 have a sawtooth shape. Specifically, each tip 26A ends in a pair of contiguous beveled teeth with each bevel reaching a peak followed by a sharp (axial) decline.

The barrel 18 and shuttle 22 as well as its teeth 20 and 24 are part of a mechanism that may be designed in accordance with U.S. Pat. No. 3,191,329 or 4,991,988, the disclosures of which are incorporated herein by reference. Moreover, any one of a number of known mechanisms for retracting and extending a ballpoint pen may be employed herein.

Elongated writing element 28 is shown as an ink-filled tube having a slender distal section 28A and a fatter section 288 that is capped with a stopper 30. Stopper 30 is installed inside shuttle 22. Fitted into the distal end of section 28A is a writing tip 32, which is a conventional ballpoint writing tip, although various other types of writing tips can be used instead.

FIG. 2 shows tip 32 biased to a retracted position inside coaxial passage 40 by helical compression spring 36. Spring 36 is slipped around section 28A and compressed between section 28B and an annular ledge 38 formed at the inside end of passage 40 in the distal end 128 of section 12. By operating the mechanism 16/18/22 in a manner to be described presently, tip 32 can be pushed into the extended position shown in FIG. 1.

Passage 40 of FIG. 2 leads to a narrower, cylindrical, coaxial, longitudinal tunnel 42 inside cylindrical collar 44. Rectangular tab 46 is a rectangular prism extending radially from the distal end of collar 44 to form a handcuff key. In this embodiment collar 44 has an exemplary outside diameter of about ⅛ inch. Tab 46 has a radial dimension of about 1/16 inch (1.6 mm) and an axial dimension of about 5/32 inch (4.0 mm), although other dimensions may be employed in other embodiments.

To facilitate an understanding of the principles associated with the foregoing apparatus of FIGS. 1 and 2, its operation will be briefly described in connection with FIG. 3. Assume that initially the combination of FIG. 2 is assembled with writing tip 32 retracted as shown. Pushbutton 16 can then be depressed to move shuttle 22 and writing element 28 distally as teeth 24 slide in the spaces between ribs 26. At this time the peaks of the teeth of rim 20 bear on the center of the beveled backside of teeth 24. In this initial phase, elements 18 and 22 are prevented from rotating by ribs 26. Eventually teeth 24 move past ribs 26 at which time the teeth of rim 20 will rotate shuttle 22 approximately one half the width of a tooth of rim 20, as the teeth 24 fall into the valley between the teeth of rim 20.

When pushbutton 16 is released spring 36 drives shuffle 22 and barrel 18 back until the beveled backside of the teeth 24 encounters the ribs 26 and drop between the pair of teeth 26A. As they drop between the pair of teeth 26A, teeth 24 are rotated by teeth 26A the same amount as before (that is, another half tooth-width so that cup 18 has rotated in total the full width of a tooth of rim 20). While teeth 24 have rotated, the teeth of rim 20 have not, so the previously described orientation recurs (that is, the peaks of the teeth of rim 20 bear on the center of the beveled backside of teeth 24). This orientation persists as barrel 18 and shuttle 22 slide back between ribs 26, and eventually reach the original orientation as shown in FIG. 2.

Accordingly, by reciprocating pushbutton 16, writing tip 32 will alternate between the retracted position of FIG. 2 and the extended position of FIG. 1. It will be noted that writing tip 32 will reciprocate much further than a conventional writing instrument, that is, the tip extends much further and retracts more deeply than an ordinary pen. To accommodate this exaggerated reciprocation pushbutton 16 is relatively long as are ribs 26.

When extended as shown in FIG. 1 the combination can be used like an ordinary writing instrument. When retracted, the combination of FIG. 2 can be worn in an officer's shirt pocket, using clip 17 to hold the device in place. Placement in a shirt pocket is not only convenient, it makes the device inconspicuous so a suspect will have no incentive to try to cease and use the device. The device will not give the appearance of a handcuff key or of an instrument that can be used as a weapon.

Figure 3:
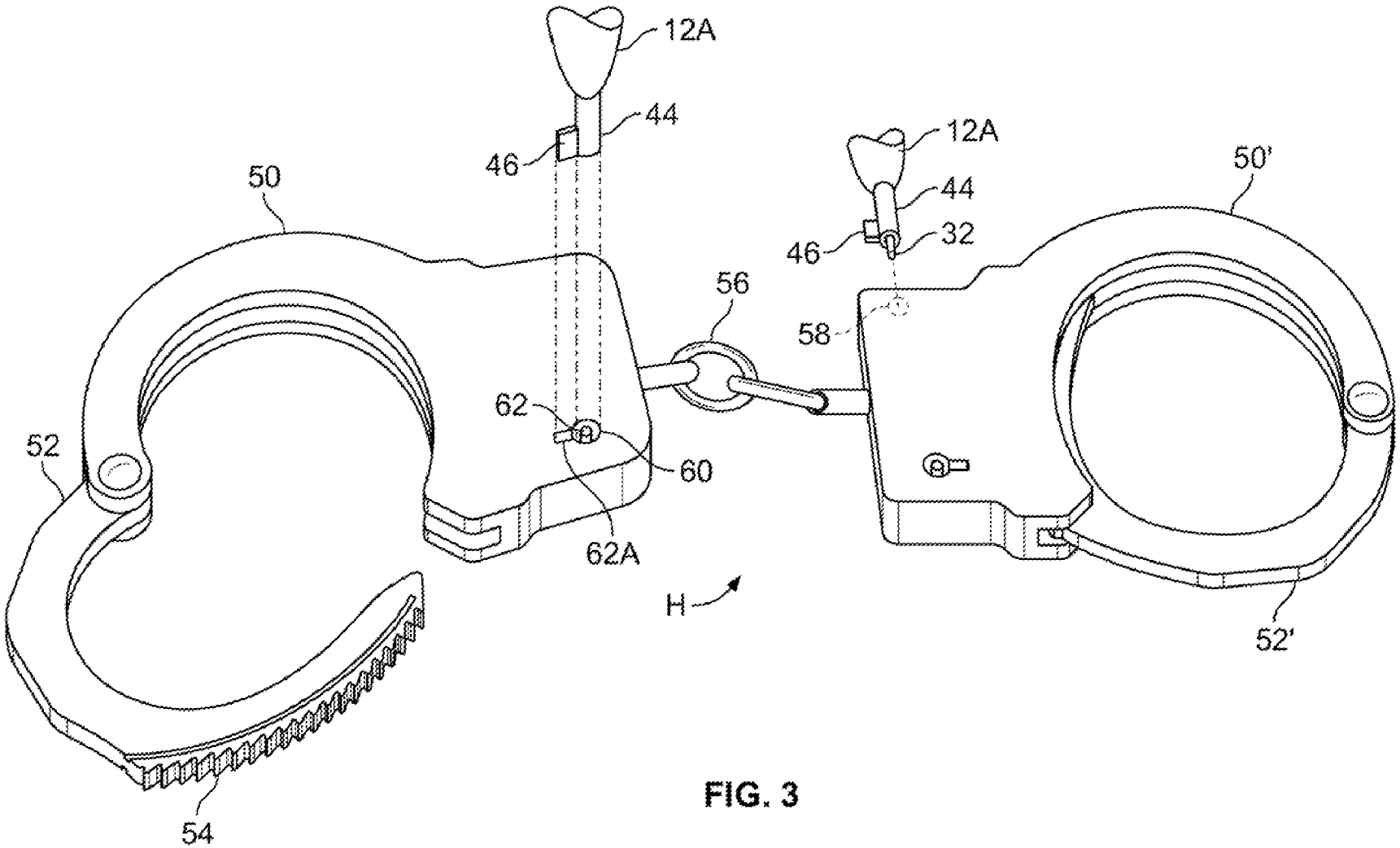
FIG. 3 is a perspective view showing the combination of FIG. 1 being used with a pair of handcuffs.

In many cases an officer will need to place the handcuffs H of FIG. 3 on a suspect's wrists. The open half 50 will be placed against the wrist and the other half 52 will be swung inwardly so ratchet teeth 54 engage and lock onto half 50. A closed handcuff is shown in FIG. 3 with halves 50' and 52' locked together and connected by links 56 to the other handcuff 50/52.

Handcuff 50'/52' might be inadvertently tightened should the suspect press the handcuffs H against some object. Overtightening is a problem because the suspect can experience discomfort but an officer would be reluctant to take the risk of unlocking the handcuff simply for the purpose of readjustment. To avoid inadvertent overtightening, conventional handcuffs have a double locking feature. An officer can execute the double locking feature using the combination of FIG. 1.

By pressing pushbutton 16 as described before, writing tip 32 can be extended as shown in FIG. 1. As a result writing tip 32 extends a predetermined distance D beyond collar 44, in this embodiment about 5 mm (although in other embodiments the tip can extend a different amount, depending upon the desired operating characteristic of the combination). The tip's overall width (diametric dimension of the exposed portion of tip 32) is less than half the predetermined distance D that tip 32 extends and in some embodiments may be less than one third the predetermined distance D.

Being relatively long and slender, the exposed length of tip 32 can be readily inserted into the double lock hole 58, shown in phantom in FIG. 3 on the edge of handcuff half 50'. Pushing tip 32 firmly into hole 58 actuates the double locking feature so that handcuff halves 50' and 52' cannot be further tightened. Thereafter, pushbutton 16 can be reciprocated to retract writing tip 32 into the position shown in FIG. 2 and clip 17 used to store the device in the officer's shirt pocket.

The device can later be retrieved from the shirt pocket and used to unlock handcuffs H of FIG. 3. With the tip 32 retracted, collar 44 can be inserted into keyhole 60 of FIG. 3. Tab 46 will be aligned with the keyhole's slot 62A while tunnel 42 (FIG. 2) will fit over the post 62 in keyhole 60. It is important to note that tunnel 42 is clear for substantially its entire length, that is, about ⅜ inch (1 cm). To accommodate post 62, it is desirable to keep tunnel 42 clear to a depth of at least 5/16 inch (8 mm), although other clearance depths can be chosen depending on the desired operating characteristics and the expected effective length of post 62.

Once collar 44 and tab 46 is fully inserted into keyhole 60, housing 12/14 can be rotated, thereby rotating tab 46 to unlock the handcuff halves 50/52, which separate as shown in FIG. 3. Thereafter, the device can be returned to the officer's shirt pocket as before.

It is appreciated that various modifications may be implemented with respect to the above described embodiments. While the foregoing is shown as two sections threadably connected at the midsection of the housing assembly, in other embodiments a housing assembly can be disassembled by removing a short cap attached to either end by threads, a force fit, bayonet coupling, etc. The foregoing writing implement is shown as a ballpoint pen, but other embodiments may incorporate instead a mechanical pencil, felt tip, or other types of writing implements. While just two positions are shown (extended and retracted), in some embodiments the writing tip may be extended modestly for writing and maximally for operating a double locking feature. Mechanisms for axially reciprocating the writing element can include threadably connected, telescopic sections that can be threaded and unthreaded to reciprocate the writing element. Other mechanisms can include longitudinally slidable buttons that can be pressed and snapped into different longitudinal positions to adjust the deployment length of the writing element.

Obviously, many modifications and variations of the present invention are possible in light of the above teachings. It is therefore to be understood that within the scope of the appended claims the invention may be practiced otherwise than as specifically described.

The invention claimed is:

1. A combination writing instrument and handcuff accessory comprising:

an elongated writing element with a writing tip; and a housing assembly with a distal and a proximal end adapted to receive said writing element, said housing assembly including:

a key at said distal end suitable for opening a handcuff, said key having a cylindrical collar encompassing a longitudinal tunnel sized to allow passage of said writing tip; and a mechanism for reciprocating the writing element between a retracted and an extended position, said writing tip in said retracted position clearing said longitudinal tunnel for substantially its entire length in order to leave said cylindrical collar empty, said writing tip in said extended position extending (a) through said tunnel, and (b) outside said housing assembly a predetermined distance.

2. A combination writing instrument and handcuff accessory according to claim 1 wherein said writing tip has a length exceeding that of said tunnel by about said predetermined distance.

3. A combination writing instrument and handcuff accessory according to claim 1 wherein the portion of said writing tip exposed in said extended position has an overall width that is less than half said predetermined distance.

4. A combination writing instrument and handcuff accessory according to claim 1 wherein the portion of said writing tip exposed in said extended position has an overall width that is less than one-third said predetermined distance.

5. A combination writing instrument and handcuff accessory according to claim 1 wherein said predetermined distance is about 5 mm.

6. A combination writing instrument and handcuff accessory according to claim 1 wherein said a cylindrical collar has a distal portion with a radially extending rectangular tab.

7. A combination writing instrument and handcuff accessory according to claim 1 wherein said housing assembly has at its proximal end an external clip for holding said housing assembly in a shirt pocket.

8. A combination writing instrument and handcuff accessory according to claim 1 wherein said mechanism has a longitudinal pushbutton extending externally from the proximal end of said housing assembly.

9. A combination writing instrument and handcuff accessory according to claim 8 wherein said pushbutton has a distal cam surface, said mechanism comprising:

a shuttle mounted coaxially in said pushbutton and having distal teeth for engaging said cam surface, said writing element being coaxially mounted in said shuttle, said housing assembly having longitudinal ribs distributed circumferentially inside said housing assembly around said shuttle, said distal teeth being positionable to either slide between or rest end to end on said longitudinal ribs.

10. A method employing a hollow key with a cylindrical collar encompassing a longitudinal tunnel formed on a writing end of a writing instrument having a retractable writing element, the method comprising the steps of:

retracting the writing element to clear the longitudinal tunnel in order to leave the cylindrical collar empty;

extending the writing element from the writing instrument through the key; and inserting the portion of the writing element extending from the key into a double lock hole of a handcuff.

11. A method according to claim 10 comprising the step of:

retracting the writing element through the key into said writing instrument; and inserting the key into the lock of a handcuff.

12. A method according to claim 10 comprising the step of:

extending the writing element from the writing instrument through the key; and writing with the writing element.

13. A combination writing instrument and handcuff accessory comprising:

an elongated writing element with a writing tip; and a housing assembly with a distal and a proximal end adapted to receive said writing element, said housing assembly including:

an external clip at the proximal end of said housing assembly for holding it in a shirt pocket;

a key at said distal end suitable for opening a handcuff, said key including a cylindrical collar having a distal portion with a radially extending rectangular tab, said collar encompassing a longitudinal tunnel sized to allow passage of said writing tip; and a mechanism for reciprocating the writing element between a retracted and an extended position, said writing tip in said retracted position clearing said longitudinal tunnel for substantially its entire length in order to leave said cylindrical collar empty, said wring tip in said extended position extending (a) through said tunnel, and (b) outside said housing assembly a predetermined distance, said writing tip having a length exceeding that of said tunnel by about said predetermined distance, said mechanism including:

a longitudinal pushbutton extending externally from the proximal end of said housing assembly and having an internal distal cam surface; and a shuttle mounted coaxially in said pushbutton and having distal teeth for engaging said cam surface, said writing element being coaxially mounted in said shuttle, said housing assembly having longitudinal ribs distributed circumferentially inside said housing assembly around said shuttle, said distal teeth being positionable to either slide between or rest end to end on said longitudinal ribs.

* * * * *